US005551203A

United States Patent [19]

Alderman et al.

[11] Patent Number: 5,551,203

[45] Date of Patent: Sep. 3, 1996

[54] METHOD FOR FORMING AN INSULATED ROOF STRUCTURE HAVING A HEAT REFLECTIVE LAYER

[75] Inventors: Robert J. Alderman, San Antonio; James E. Taylor, Sequin, both of Tex.

[73] Assignee: Owens Corning Fiberglas Technology, Inc., Summit, Ill.

[21] Appl. No.: 470,379

[22] Filed: Jun. 6, 1995

Related U.S. Application Data

[62] Division of Ser. No. 147,511, Nov. 5, 1993.

[51] Int. Cl.[6] ..... E04G 21/14

[52] U.S. Cl. ..... 52/746.11; 52/749.12; 52/404.1; 52/478

[58] Field of Search ..... 52/404.1–404.3, 52/407.3–407.5, 408–410, 478, 483.1, 746.11, 749.12

[56] References Cited

U.S. PATENT DOCUMENTS

| | | | |
|---|---|---|---|
| 2,782,914 | 2/1957 | Giles . | |
| 3,559,914 | 2/1971 | Alderman . | |
| 3,969,863 | 7/1976 | Alderman . | |
| 3,983,676 | 10/1976 | Gilpin . | |
| 4,047,345 | 9/1977 | Alderman . | |
| 4,068,446 | 1/1978 | Brueske . | |
| 4,075,806 | 2/1978 | Alderman . | |
| 4,075,807 | 2/1978 | Alderman . | |
| 4,078,355 | 3/1978 | Clemensen . | |
| 4,117,641 | 10/1978 | Wells . | |
| 4,147,003 | 4/1979 | Alderman . | |
| 4,222,212 | 9/1980 | Alderman . | |
| 4,263,763 | 4/1981 | Bouwens . | |
| 4,346,543 | 8/1982 | Wilson et al. . | |
| 4,446,664 | 5/1984 | Harkins . | |
| 4,449,343 | 5/1984 | Henningsen . | |
| 4,573,298 | 3/1986 | Harkins | 52/746.11 X |
| 4,651,489 | 3/1987 | Hodges et al. | 52/409 |
| 4,656,808 | 4/1987 | Mansfield . | |
| 4,726,985 | 2/1988 | Fay et al. . | |
| 4,736,552 | 4/1988 | Ward et al. . | |
| 4,967,535 | 11/1990 | Alderman . | |
| 5,491,952 | 2/1996 | Alderman et al. | 52/749.12 |

FOREIGN PATENT DOCUMENTS

| | | |
|---|---|---|
| 839772 | 10/1937 | France . |
| 2590609 | 11/1985 | France . |
| 3516192 | 5/1985 | Germany . |
| 8400783 | 3/1984 | WIPO . |

*Primary Examiner*—Robert J. Canfield
*Attorney, Agent, or Firm*—C. Michael Gegenheimer

[57] ABSTRACT

A method and apparatus for installing insulation material within a roof structure (11). The apparatus includes a carriage (26) which is urged along the purlins (18) of the roof structure (11). A roll of insulation material (43) is mounted to the carriage (26) and dispenses a substantially continuous sheet of blanket insulation material (39) over the purlins (18) as the carriage (26) is progressively moved along the length of the purlins (18). A radiant barrier dispenser (70) dispenses a layer of radiant barrier material (72) over the dispensed blanket insulation material (39), and a cross-wise layer of insulation (86) is applied across the length of the purlins (18) in a direction normal to the direction of application of the blanket insulation material (39). Thereafter, sheets of hard metal roofing material (24) are attached to the purlins (18) over the cross insulation (86) to form the insulated roof structure (11).

4 Claims, 4 Drawing Sheets

METHOD FOR FORMING AN INSULATED ROOF STRUCTURE HAVING A HEAT REFLECTIVE LAYER

This is a division of application Ser. No. 08/147,511, filed Nov. 5, 1993.

FIELD OF THE INVENTION

The present invention relates to a method and apparatus for applying a blanket of insulation material and a radiant barrier material above the purlins of the roof structure to form a roof structure having improved insulation capabilities.

BACKGROUND OF THE INVENTION

The roof structure of most conventional industrial buildings typically include rafters, purlins mounted on the rafters, and sheets of hard metal roofing material are mounted over the purlins. Blankets of insulation material typically are rolled out over the purlins, sandwiched between the purlins and the sheets of hard metal roofing material. Examples of such insulated roof structures are disclosed in U.S. Pat. Nos. 3,559,914, 4,047,345 and 4,147,003.

It has been proposed to combine sheets of radiant barrier materials, such as metal foils, between the blankets of insulation and the hard metal roofing material for retarding heat transfer through roof structures. A problem with such radiant barrier materials is that they are difficult and expensive to uniformly install, increasing the costs of insulating the roof structure. To provide an effective barrier against heat transfer, an air space or cavity in which the radiant barrier is positioned also is needed to enable the foil to reflect heat and retard its passage through the roof. If the upper blanket is in direct contact with the foil, the foil will tend to conduct, instead of reflect, heat through the roof and into the building.

Such air spaces generally have had to be formed by hand during the installation of the insulation blankets and reflective barrier materials, increasing installation costs. Additionally, the air spaces are typically formed above the blanket insulation material, and are exposed from above. As a result, dust can collect on the radiant barrier material, making it less reflective, which tends to diminish its effectiveness for retarding heat transfer.

Accordingly, it can be seen that it would be desirable to provide an apparatus and method of installing insulation material and a radiant barrier material into a roof structure for an industrial building that is easier and more economical to use to form an insulated roof structure having improved insulation and heat transfer retardant characteristics.

SUMMARY OF THE INVENTION

Briefly described, the present invention comprises a method and apparatus for installing insulation materials in a roof structure of the type having a series of parallel, spaced apart rafters on which are mounted a series of spaced parallel purlins extending in a direction normal to the length of the rafters and over which sheets of hard metal roofing material are attached. The apparatus for applying insulation materials includes a mobile carriage having a pair of spaced rollers rotatably mounted thereto, for engaging and rolling along the upper surfaces of the purlins for moving the carriage along the purlins.

An insulation support means is mounted to the carriage and supports a roll of a blanket insulation material, typically a fiberglass insulation material, although other types of insulation material can be utilized. The blanket insulation material is progressively dispensed along the length of the purlins in substantially continuous sheets overlapping the upper surfaces of adjacent pairs of purlins as the carriage is moved along the purlins.

A radiant barrier dispenser mounted on the carriage includes a supply reel of a radiant barrier material such as a metal foil. A pair of intermeshing crimp rollers are positioned immediately downstream from the radiant barrier supply reel. The radiant barrier material is passed between the crimp rollers as the radiant barrier layer is dispensed in order to form corrugations the radiant barrier layer.

After the layer of radiant barrier material is applied over the blanket insulation material, usually a cross layer of fiberglass insulation material is installed over the radiant barrier material. As the cross layer of insulation material is applied, it is maintained under tension in order to prevent it from sagging and filling the air space within which the radiant barrier material is positioned. Sheets of hard metal roofing material are thereafter installed over the cross layer of insulation to complete the roof structure.

It is an object of this invention to provide an apparatus for applying a layer of insulation material to a roof structure in which the application of the insulation material is controlled so as to form an air space or cavity in which a radiant barrier layer is received to enhance the insulation characteristics of the roof structure.

Another object of this invention is to provide an apparatus for dispensing an insulation blanket over the purlins of a roof structure and having a radiant barrier dispenser attached thereto for dispensing a radiant barrier layer onto the upper surface of the insulation material.

Another object of this invention is to provide an insulated roof structure having improved insulation capabilities, which is economical and easy to install.

Other objects, features and advantages of the present invention will be understood from a review of the following specification when taken in conjunction with the accompanying drawings.

DETAILED DESCRIPTION OF THE PREFERRED EMBODIMENT

Figure 1:
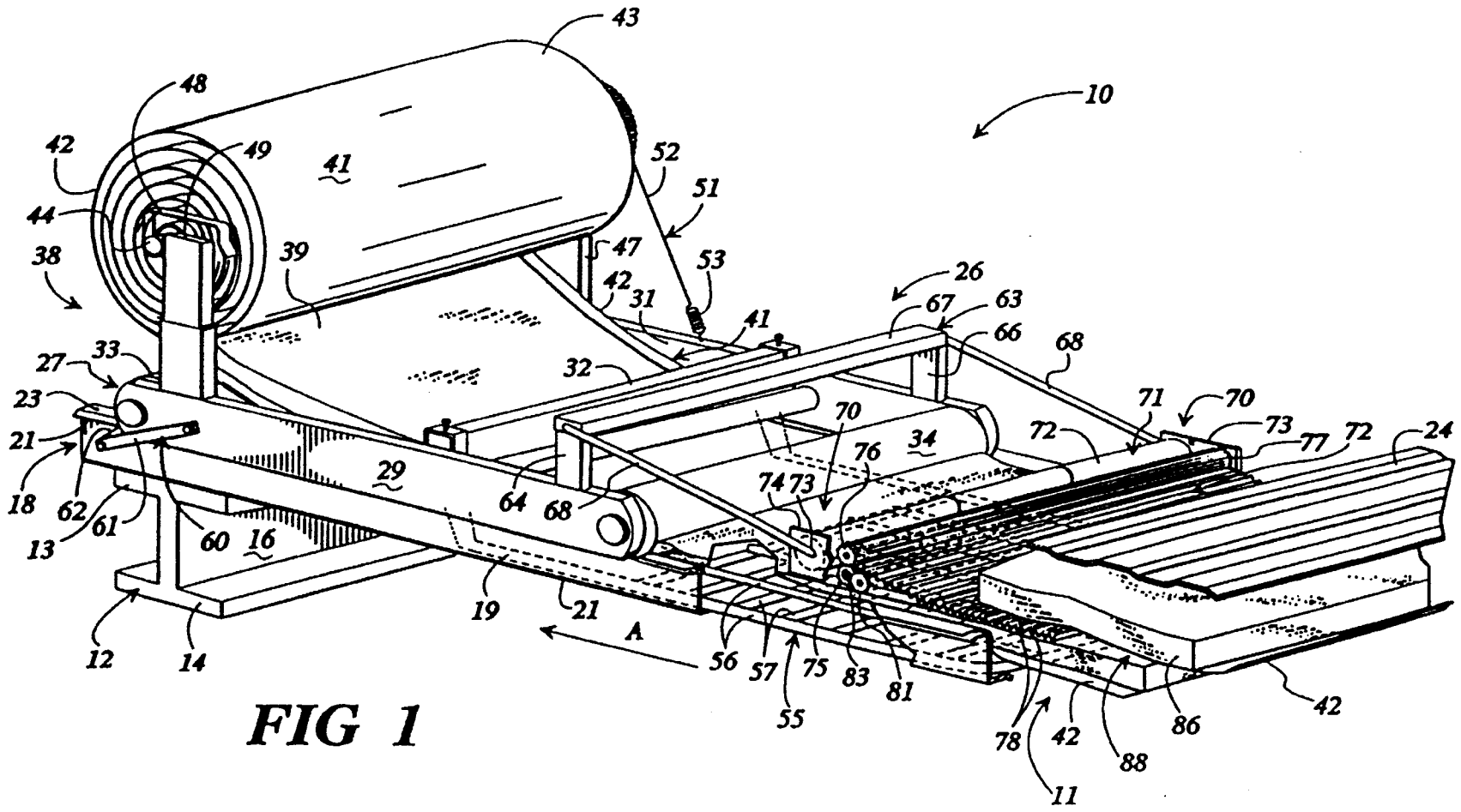
FIG. 1 is a perspective view of the roofing apparatus for applying a blanket insulation material and a radiant barrier layer to the purlins of a roof structure.

Referring now in greater detail to the drawings, FIG. 1 illustrates a roofing apparatus 10 for applying insulation materials to a roof structure 11 for large industrial buildings such as pre-engineered metal buildings. The roof structure 11, illustrated in part, generally includes a series of spaced apart parallel rafter beams 12 (only one of which is shown). Each rafter beam 12 typically is substantially I-shaped having an upper flange 13, a lower flange 14, and a central web 16. A plurality of mutually spaced, parallel purlins 18 (only two of which are shown) are mounted to the upper flange 13 of each rafter beam 12. The purlins generally are spaced approximately 60 inches apart and are supported by the rafter beams. Each purlin has a substantially Z-shaped configuration and includes a central web 19, a lower flange 21 and an upper flange 22. It should be noted that although the purlins shown have a Z-shaped configuration, the present invention is equally well suited for use with purlins of substantially different configurations.

As FIG. 1 illustrates, the roofing apparatus 10 includes a carriage or framework 26 having a first end 27 and a second end 28. The carriage 26 includes a pair of longitudinal side bars 29 and 31 extending approximately parallel to the upper surfaces 23 of the purlins 18. The side bars are spaced apart a distance slightly greater than the span between adjacent purlins, slightly overlapping the outer side edges of the purlins as the carriage travels along the purlins.

Figure 2:
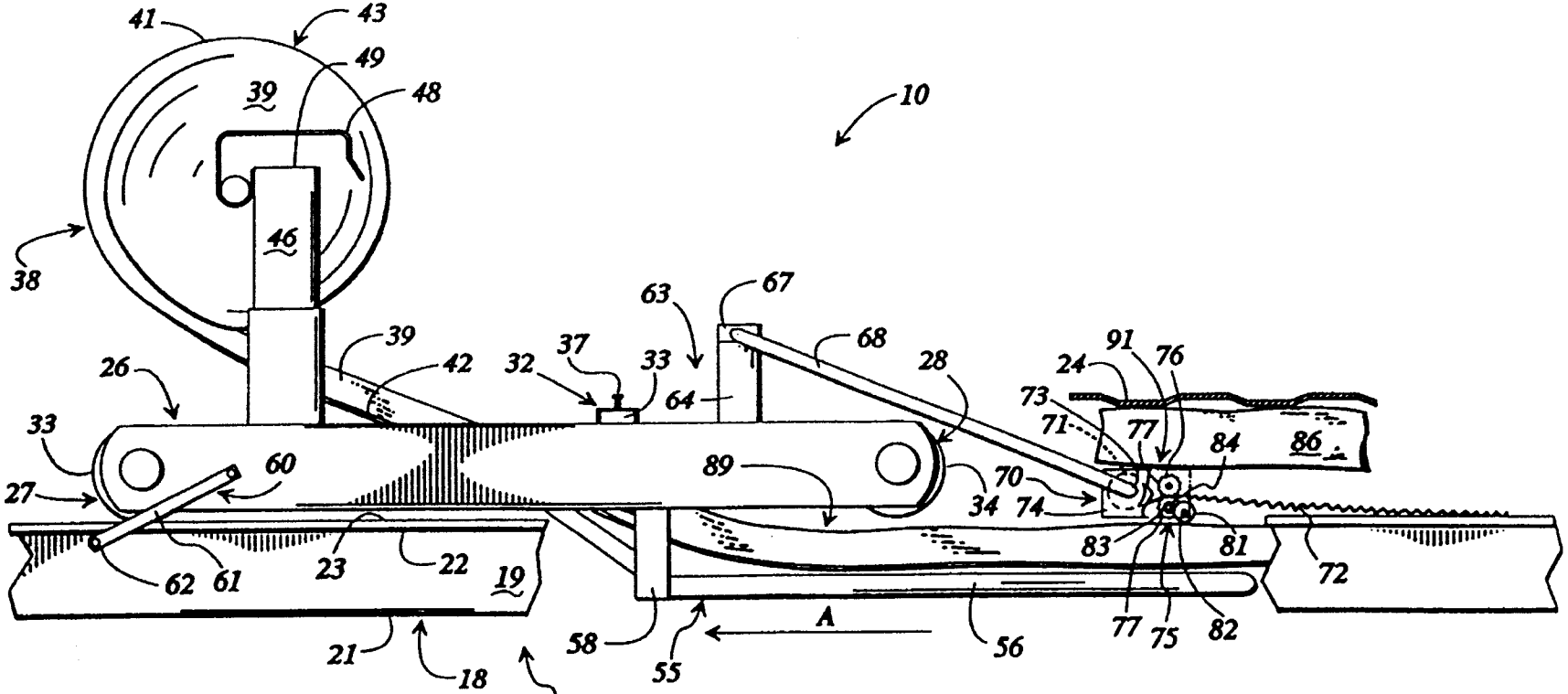
FIG. 2 is a side elevational view of the roofing apparatus for applying a blanket insulation material and a radiant barrier layer to the purlins of a roof structure.

A cross bar 32 is attached to each side bar 29 and 31, extending across the span between the adjacent purlins. As illustrated in FIGS. 1 and 2, first and second rollers 33 and 34 are rotatably mounted to the side bars 29 and 31 at the ends 27 and 28 thereof. Each roller is a substantially cylindrical member having a length that is greater than the spacing between the purlins, and extends across the span between adjacent purlins. The rollers roll along the upper surfaces 23 of the upper flanges 22 of the purlins 18 to move the carriage along the purlins in the direction of arrow A.

An insulation dispensing means 38 is provided adjacent the first end 27 of the carriage for dispensing a blanket of thermal insulation material 39. The insulation material 39 typically is a fiberglass insulation blanket, or a similar thermal insulation material, and generally is of a width slightly less than the spacing between the purlins. A vinyl, paper, or other sheet backing 41 applied to one side of the blanket of insulation material, and is of a substantially greater width than the blanket of insulation material and the spacing between the purlins. As a result, the backing 41 overlaps the blanket of insulation material, forming flaps 42 projecting away from each side of the blanket of insulation material. The blanket of insulation material 39 is wound into a supply roll 43 about a spindle 44. The blanket of insulation material 39 is progressively dispensed from its supply roll 43, deposited between the purlins, with the backing flaps overlapped over the upper flanges 22 of the purlins 18 as the carriage travels along the purlins.

A pair of upright stanchions 46 and 47 are mounted to the side bars 29 and 31, adjacent the first end of the carriage at a position intermediate the first roller 33 and the cross bar 32, and extend vertically therefrom. The stanchions support the supply roll 43 of insulation as the blanket insulation material 42 is dispensed from the supply roll. A resilient clip 48 is mounted to each of the stanchions adjacent their upper ends 49. The clips releasibly receive and rotatably hold the spindle 44 for the roll of insulation material 43. As a result, the spindle is secured to the stanchions as against vertical movement but is able to freely rotate to dispense the insulation material from its supply roll.

As shown in FIG. 1, a drag 51 is provided about one end of the spindle 44. The drag generally comprises a rubber strap or band 52 attached at each end to a tension spring 53 (only one shown) mounted to the upper surface of side bar 31. The strap 52 is looped about a sprocket mounted to the end of the spindle 44 and exerts a frictional tension force thereon to prevent uncontrolled rotation of the spindle unless sufficient force is exerted on the spindle to overcome the tension of the strap. A braking means (not shown), such as a ratchet and pawl, is mounted to one end of the first roller 33 and to an adjacent side bar 29 or 31 for inhibiting movement of the roller in a reverse direction, which would enable the carriage to slide or roll in the opposite direction from arrow A. This prevents the carriage from rolling back and becoming tangled in the layer of just dispensed insulation material being applied to the purlins, or becoming tangled or bunching about the purlins.

As illustrated in FIGS. 1 and 2, a support frame 55 is mounted to the carriage 26 and extends rearwardly from the second end of the carriage between the pair of adjacent purlins 18, beneath a portion of the insulation material 42 that has been dispensed onto the purlins. The support frame 55 generally is a lattice structure having a series of longitudinally extending bars 56 overlaid with a series of laterally extending bars 57 extending crosswise across the longitudinal bars 56.

As FIG. 2 illustrates, the support frame is attached at one end to the underside of the carriage and is further attached to the carriage at an intermediate portion by brackets 58. The support frame 55 functions as a support for the insulation material as it is applied onto the purlins 18.

As FIG. 1 illustrates, an upright U-shaped frame 63 is mounted to the side bars 39 and 31 of the carriage 26 and extends across the span between the pair of purlins 18 over which the carriage is traveling. The upright frame 63 includes a pair of vertically oriented legs 64 and 66 mounted to the upper surfaces of the side bars 29, and a rectangular cross piece 67 that extends between and is attached to the upper ends of the legs 64 and 66, spanning the space between adjacent purlins. Tethers 68 are attached to the legs 64 and 66 of the upright frame 63, adjacent the upper ends of the legs. The tethers are generally resilient, substantially inelastic cables, chains, or other similar types of connecting means. The tethers are attached at their opposite ends to a radiant barrier dispenser 70 displaced from the second end 28 of the carriage and secure the radiant barrier dispenser to the carriage such that the radiant barrier dispenser trails behind and moves with the carriage 26 as the carriage travels along the purlins 18.

Figure 3:
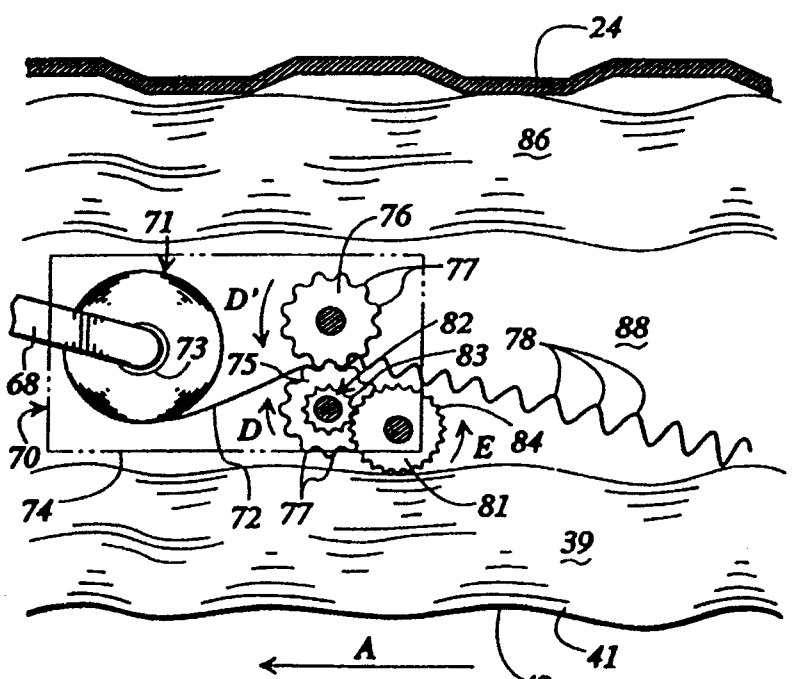
FIG. 3 is a side elevational view of the radiant barrier dispenser, schematically illustrating the intermeshing engagement of the crimp rolls with the radiant barrier layer for forming corrugations in the radiant barrier layer.

As shown in FIGS. 1 and 3, the radiant barrier dispenser 70 includes rotatable supply rolls 71 that dispense a layer of a radiant barrier material 72 (Figs. 2 and 3) as they are rotated in the direction of arrow C with the forward movement of the roofing apparatus 10. Typically, one to three supply rolls (FIG. 1) are used, mounted in an overlapping relationship on spindles 73 to insure adequate coverage of the radiant barrier material. The layer of radiant barrier material 72 dispensed onto the blanket insulation material is of a substantially smaller width than the blanket insulation material, although it will be understood that the width of the radiant barrier material can be greater or less to fit the particular application in the roof structure. The radiant barrier material 72 typically is a metal foil, such as an aluminum foil, or a similar reflective material having heat reflective characteristics. Such foil materials have been found to significantly enhance the insulation capabilities of a roof structure as they tend to reflect heat and retard heat transfer through the roof structure.

As FIG. 3 illustrates, a bracket 74, illustrated in phantom, is attached to each end of the supply roll and serves to stabilize the supply roll as the radiant barrier is dispensed, and supports a pair of opposed intermeshing crimp rolls 75 and 76. The crimp rolls 75 and 76 are rotatably mounted at each end to the brackets. The crimp rolls each include a series of flutes or teeth 77 formed thereabout. The crimp rolls are positioned one on top of the other with their flutes 77 meshing as the crimp rolls are rotated in the direction of arrows D and D'. The layer of radiant barrier material 72 dispensed from supply reel 71 is received between the intermeshing flutes, which tend to pull the radiant barrier material progressively from its supply roll. The engagement of the radiant barrier material by the crimp rolls creates substantially V-shaped corrugations or pleats 78 within the radiant barrier material as it is applied to the blanket insulation material.

Figure 4:
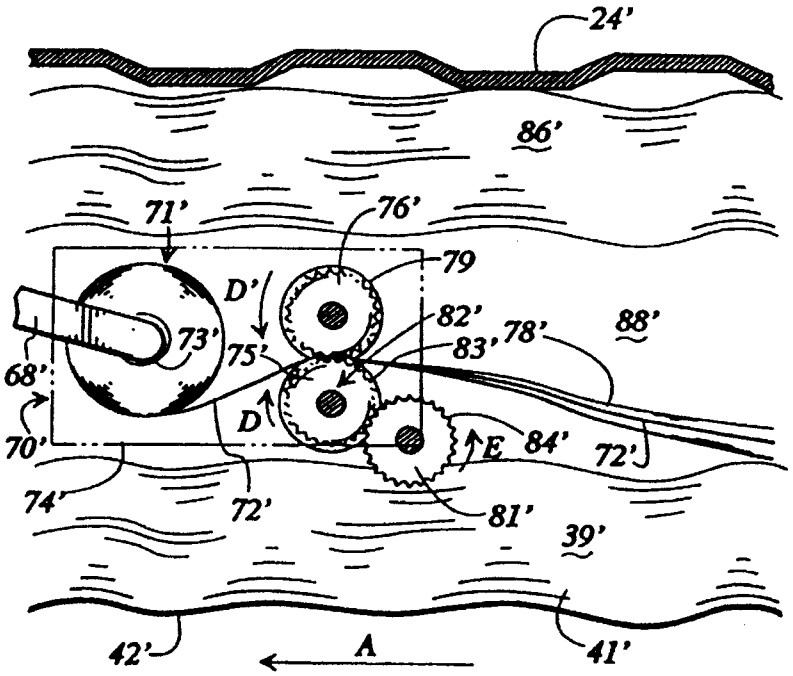
FIG. 4 is an additional embodiment of the radiant barrier dispenser dispensing a radiant barrier layer with longitudinal corrugations formed therein.

As shown in FIG. 3, the corrugations 78 generally extend laterally across the width of the layer of radiant barrier material. It is, however, also possible to form the corrugations 78 longitudinally, along the length of the layer of radiant barrier material, as FIG. 4 illustrates. As shown in FIG. 4, crimp rolls 75' and 76' are formed with ridges 79 in place of the flutes of Fig. 3. The ridges 79 engage and deform the radiant barrier material, forming longitudinal corrugations 78'. It is further possible to apply the radiant barrier material in a substantially flat sheet without corrugations if desired. For such an application, the crimp rolls are removed and the radiant barrier material is fed directly onto the upper surface of the blanket insulation material.

As shown in FIG. 3, a drive roll 81 is rotatably mounted to the brackets 74 and engages and rolls along the upper surface of the blanket insulation material, rotating in the direction of arrow E, as the radiant barrier dispenser trails behind the carriage. The drive roll 81 is a toothed sprocket or gear having a series of teeth 82 arranged about its circumference. A smaller drive gear 83 is attached to one end of the lower crimp roll 75 and has a series of teeth 84 arranged about its circumference. The teeth 84 of small drive gear 83 engage and mesh with the teeth 79 of the drive roll 78 such that as drive roll 81 rolls along the upper surface of the blanket insulation material 42, its teeth 82 mesh with the teeth of the small drive gear causing the small drive gear to rotate in the opposite direction. The rotation of the small drive gear in turn causes the lower crimp roll 75 to be rotated in the direction of arrow D. As the lower crimp roll 75 is rotated, its flutes 77 engage and mesh with the flutes of the upper crimp roll 76, causing the upper crimp roll to rotate in the direction of arrow D'.

Figure 5:
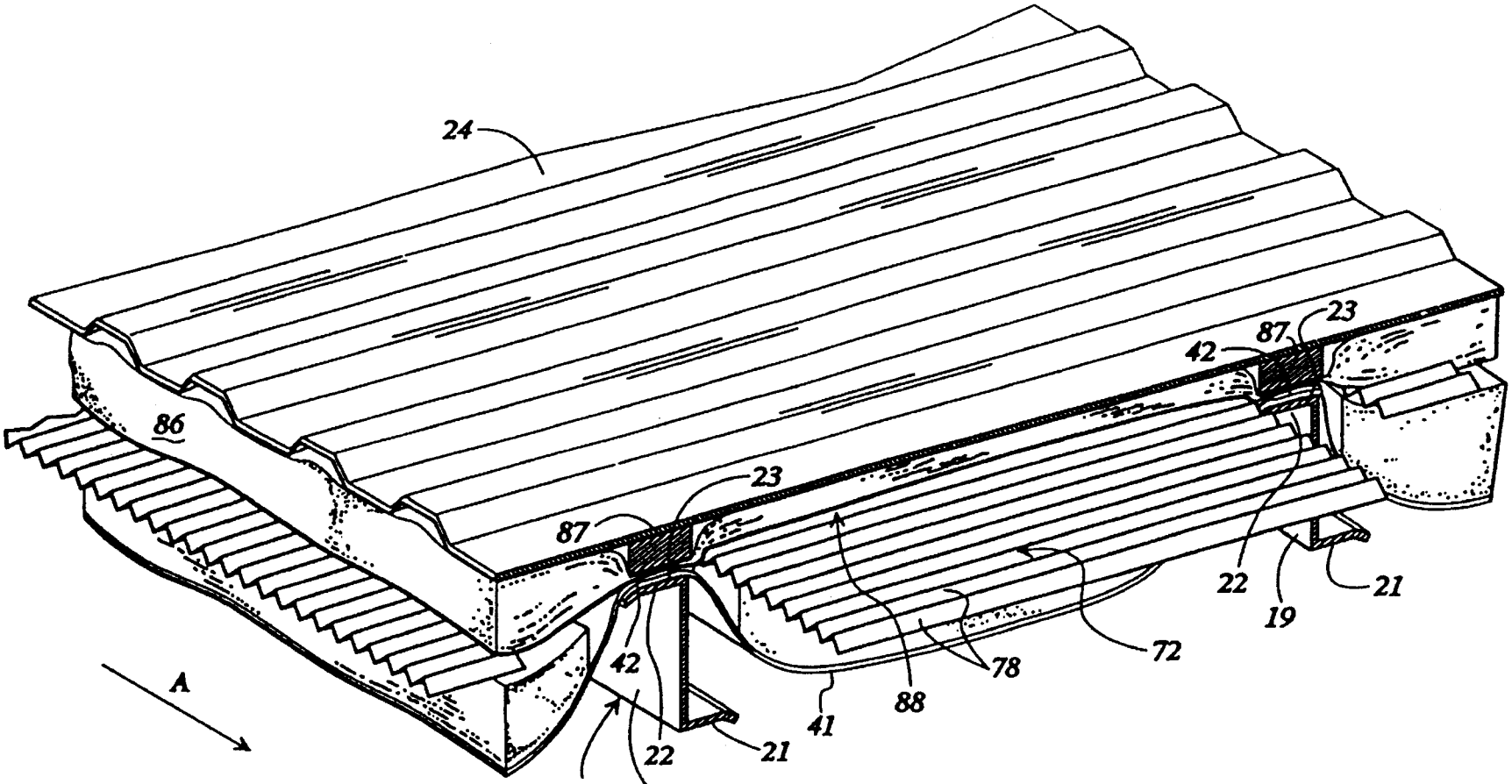
FIG. 5 is a perspective view taken in cross-section of the insulated roof structure.

As shown in FIGS. 1 and 5, a cross layer of thermal insulation material 86, such as a fiberglass insulation blanket without a backing sheet, is applied over the blanket insulation material and the radiant barrier material, extending in a direction normal to the direction of the application of the blanket insulation material and layer of radiant barrier material. Thermal spacer blocks 87 are positioned over the cross layer of insulation 86 and the backing flaps 42 of the blanket insulation material 39, resting on the upper surfaces 23 of the upper flanges 22 of the purlins 18. Thereafter, sheets of hard metal roofing material 24 are received on top of the thermal spacer blocks and are attached to the upper flanges 22 of the purlins as by rivets or similar fasteners.

In operation of the roofing apparatus 10, as illustrated in FIG. 1, for installing insulation materials in the roof structure 11, the carriage 26 of the roofing apparatus is positioned over and engages the upper surfaces 23 of a pair of spaced apart purlins 18, with the side bars of the carriage overlapping the upper surfaces of the purlins. The rollers 33 and 34 are received upon and roll along the upper surfaces of the purlins to move the carriage along the purlins. Purlin engaging members 60, attached at the first end 27 of the carriage 26, engage in the underside surfaces of the upper flanges 22 of the purlins 18. Fingers 62 at the ends of the purlin engaging members hook under the edges of the upper flanges 22 to secure the first end of the carriage against the purlins and resist upward movement by the carriage away from upper surfaces of the purlins.

Once the carriage has been so positioned on the purlins, the carriage is progressively urged in the direction of arrows A (FIG. 1) along the upper surfaces of the purlins. The movement of the carriage is accomplished manually by a worker standing on a completed segment of the roof structure 11 and urging the carriage forwardly by pushing the carriage with a pole or similar means. The carriage is guided along the upper surfaces of the purlins by the engagement of its rollers 33 and 34 with the upper surfaces 23 of the purlins 18. The roofing apparatus 10 is prevented from backing up, under the pull exerted on it by the dispensed blanket insulation material, by a braking means (not shown).

As FIGS. 1 and 2 illustrate, as the carriage 26 travels along the purlins, the blanket insulation material 39 is progressively dispensed from its supply roll 43. The blanket insulation material is applied between the purlins 18, in frictional contact with the central webs 19 of the purlins, and the flaps 42 of the backing 41 are overlapped over the upper surfaces of the purlins. The flaps can be temporarily secured to the upper surfaces of the purlins as by tape or similar means, to prevent slipping or sagging of the blanket insulation material until secured with the application of the sheets of hard metal roofing material. As the blanket insulation material 39 is dispensed, the support frame 55 supports and maintains the position of the blanket insulation material on top of the purlins to prevent the blanket from sagging or falling between the purlins.

The application of the blanket insulation material is controlled so that an air space 88 (FIGS. 1 and 5) is created above the upper surface of the blanket insulation material. The air space 88 further enhances the insulation properties of the roof structure by trapping d"dead air," which aids in retarding transfer of heat through the insulation material. The size of the air space is controlled by controlling the application of the blanket insulation material.

Forward movement of the carriage along the purlins 18 is halted as the second roller 34 (FIG. 1) of the carriage 26 reaches a position spaced from a completed section of a roof structure over which a sheet of hard metal roofing material 24 has been applied. As FIG. 2 illustrates, the support frame extends from the second end of the carriage, slightly beneath the completed section of roofing. The radiant barrier dispenser 70 remains in a downstream position, indicated by 91, beneath the cross layer of insulation 86 and the hard metal roofing material 24 of a completed section of the roof structure. Thus, the foil material of the radiant barrier layer is not exposed to the elements such as wind, rain, dust, abrasion, etc. which could possibly damage or tear the radiant barrier material during application thereof and reduce its effectiveness for retarding heat transfer through the roof structure.

With the carriage 26 in its stop position 89, a cross layer of insulation 86 is applied over the dispensed blanket insulation material 39, and thermal spacer blocks 87 and a sheet of hard metal roofing material are placed thereover and attached to the purlins. The cross layer of insulation is applied under tension so that it does not sag and fill the air space 88 formed above the blanket insulation material. As a result, the air space 88 is maintained between the layers of insulation, forming an enclosed cavity within which the radiant barrier material is received. As shown in FIG. 5, the flaps 42 of the backing 41 are sandwiched between the purlins and the cross layer of insulation and the hard metal roofing material 24 and thus form a vapor barrier over the tops of the purlins.

Once a section of the roof structure has been completed, the carriage is again urged forward, along the purlins, withdrawing the support frame from beneath the completed section of the roof structure. As the carriage is moved further forwardly, the radiant barrier material is progressively dispensed from its supply rolls 71 (FIGS. 1 and 3) by the radiant barrier dispenser 70. A radiant barrier layer 72 is thus applied to the upper surface of the blanket insulation material 39. As illustrated in FIGS. 1 and 5, the radiant barrier material is received within the air space 88 formed over the upper surface of the blanket insulation material. The positioning of the radiant barrier material within the air space 88 ensures optimal radiant heat reflection by the radiant barrier material, and maintains the radiant barrier layer out of contact with the cross layer of insulation. Such contact of the radiant barrier material with both layers of insulation material tends to conduct heat through the lower blanket of insulation. Thus, placing of the radiant barrier within the air space avoids the potential for conduction of longwave heat radiation from the hard metal roof panels through the layers of insulation and into the building.

It will be understood that it is also possible for the radiant barrier material to be laminated to either the cross layer of insulation or to the lower blanket of insulation and applied with the application of such layer of insulation to the roof structure. In such circumstances, the radiant barrier material is laminated to one side of the fiberglass blanket of the insulation material and is rolled up with the fiberglass blanket into the roll of insulation.

The method of applying the insulation materials to the roof structure during construction thereof is repeated, with the roofing apparatus being urged progressively along the length of the purlins until the roof structure is completed.

Although the invention has been shown in a preferred form thereof, it should be understood that numerous changes, modifications, additions and deletions may be made thereto without departure from the spirit and scope of the invention as set forth in the following claims.

We claim:

1. A method of forming an insulated roof structure of the type including a series of spaced, parallel rafters with a plurality of mutually spaced parallel purlins mounted thereto, comprising the steps of:

urging rolls of heat insulation material along the purlins of the roof structure;

as the rolls of heat insulation material are urged along the purlins, dispensing blankets of insulation material between pairs of spaced purlins, with the dispensing of the insulation material controlled so as to form air spaces above the blankets of insulation materials;

applying layers of radiant barrier material to upper surfaces of the blankets of insulation material with the radiant barrier material received within the air spaces above the blankets of insulation material; and applying cross layers of insulation onto the blankets of insulation material, with the air spaces maintained between the blankets of insulation material and the cross layers of insulation and the cross layers of insulation positioned out of engagement with the layers of radiant barrier material.

2. The method of claim 1 and wherein the step of applying layers of radiant barrier material on the heat insulation material dispensed from the reels comprises paying out radiant barrier layers from reels of material in response to the movement of the rolls of heat insulation material along the purlins.

3. The method of claim 1 and further including the step of mounting sheets of hard metal roofing material to the purlins, with the blankets of insulation material and cross layers of insulation positioned therebeneath.

4. The method of claim 1 and further including the step of corrugating the radiant barrier material as the radiant barrier material is applied to the blankets of heat insulation material.

* * * * *